US007944404B2

(12) United States Patent
Yun et al.

(10) Patent No.: US 7,944,404 B2
(45) Date of Patent: May 17, 2011

(54) CIRCULAR POLARIZED HELICAL RADIATION ELEMENT AND ITS ARRAY ANTENNA OPERABLE IN TX/RX BAND

(75) Inventors: Jae-Seung Yun, Daejon (KR); Soon-Young Eom, Daejeon (KR); Young-Bae Jung, Daejeon (KR); Soon-Ik Jeon, Daejeon (KR); Chang-Joo Kim, Daejeon (KR)

(73) Assignee: Electronics and Telecommunications Research Institute (KR)

( * ) Notice: Subject to any disclaimer, the term of this patent is extended or adjusted under 35 U.S.C. 154(b) by 59 days.

(21) Appl. No.: 11/296,841

(22) Filed: Dec. 6, 2005

(65) Prior Publication Data

US 2006/0119532 A1 Jun. 8, 2006

(30) Foreign Application Priority Data

Dec. 7, 2004 (KR) ..... 10-2004-0102352
May 20, 2005 (KR) ..... 10-2005-0042708

(51) Int. Cl.
*H01Q 1/36* (2006.01)
*H01Q 13/00* (2006.01)

(52) U.S. Cl. ..... 343/895; 343/772

(58) Field of Classification Search ..... 343/895, 343/834, 835, 836, 837, 757, 761, 786, 772, 343/893, 789, 776

See application file for complete search history.

(56) References Cited

U.S. PATENT DOCUMENTS

| | | | | |
|---|---|---|---|---|
| 4,494,117 | A * | 1/1985 | Coleman | 342/365 |
| 4,945,363 | A * | 7/1990 | Hoffman | 343/895 |
| 5,345,248 | A * | 9/1994 | Hwang et al. | 343/895 |
| 5,699,072 | A * | 12/1997 | Tokuda et al. | 343/786 |
| 6,181,296 | B1 * | 1/2001 | Kulisan et al. | 343/895 |
| 6,266,024 | B1 * | 7/2001 | Ramanujam et al. | 343/781 CA |
| 6,819,302 | B2 * | 11/2004 | Volman | 343/895 |
| 2006/0001591 | A1 * | 1/2006 | Graggs et al. | 343/895 |

* cited by examiner

*Primary Examiner* — Jacob Y Choi
*Assistant Examiner* — Robert Karacsony
(74) *Attorney, Agent, or Firm* — Blakely & Sokoloff, Taylor & Zafman

(57) ABSTRACT

Provided are Circular Polarized Helical Radiation element and its Array Antenna operable in TX band and RX band. The circular polarized helical radiation element and its array antenna and the antenna with double reflection boards using that array can operate at TX/RX dual band which is high frequency such as Ka band by operating the helical antenna in axial mode and implementing dual feeding structure. The array antenna having a number of radiation elements operable in the both of TX band and RX band, wherein the radiation elements are arrayed on predetermined column lines, each radiation element comprising: a helix for radiating orthogonal circular polarized waves in the different frequency bands wherein the helix is fed at its beginning point and its terminating point; and a wave guide for accommodating the helix.

11 Claims, 9 Drawing Sheets

Frequency=20.755 Theta/Degree

CIRCULAR POLARIZED HELICAL RADIATION ELEMENT AND ITS ARRAY ANTENNA OPERABLE IN TX/RX BAND

FIELD OF THE INVENTION

The present invention relates to a circular polarized radiation element and its array antenna operable in TX/RX band, and more particularly, to a circular polarized radiation element, e.g., a helical radiation element, and its array antenna being capable of radiating and receiving circular polarized waves at TX band and RX band.

DESCRIPTION OF RELATED ART

In order for a radiation element to be effectively employed in a satellite communication with a frequency band, in case of a satellite communication with a Ka band, it should be able to radiate a right circular polarized wave in the band of 20.355~21.155 GHz and a left circular polarized wave in the band of 30.085~30.885 GHz.

For a satellite communication with X band, a base station should radiate a circular polarized wave(Transmission(TX) band: 7.9~8.4 GHz, Receiving(RX) band: 7.25~7.75 GHz). At Ku band, a base station should radiate a linear polarized wave (TX band: 14.0~14.5 GHz, RX band: 12.25~12.75 GHz).

In the former case, a patch antenna for use in a base station may be implemented to operate at a TX band and RX band simultaneously by cutting an opposite rectangular-shaped edges of a patch thereof as the shape of triangle and depositing the patches with two feeding points, since the required polarization is a circular polarization but one frequency band is close to the other.

In the latter case, a patch antenna can be implemented at the TX and RX band by determining the two resonance lengths of the patches according to the TX and RX band since one frequency band is relatively apart from the other but the required polarization is a linear polarization.

However, in the case of Ka band, it may difficult to implement the TX and RX bands by using a conventional patch antennas because the one frequency band is significantly apart form the other and the required polarization is a circular polarization.

Thus, in the above case, conventional Satellites or base stations should employ TX and RX radiation elements separately. As a result, the size of antenna is enlarged by double size and the overall size of an antenna system becomes relatively bulky enlarged to thereby reduce the economic efficiency and profitability of the antenna system. Therefore, it would be highly desirable to implement a helical radiation element that can radiate circular polarized waves in a broad band and orthogonal circular polarized waves satisfied with characteristic of desired mutual isolation in a dual-band, i.e., TX and RX bands.

In general, as helices of helical antenna have the same radius and pitch, the helical antenna can produce linear polarization in a normal mode, wherein the linear polarization is radiated in the vertical direction to the axis of the helix, or the helical antenna can produce a circular polarization in an axial mode, wherein the circular polarization is radiated in the same direction of the axis of the helix.

In the normal mode, the length of on turn of a helix is the integer multiple of the wave length and the pitch is $\lambda/2$. The waves are radiated in a vertical direction to the axis of the helix.

In the axial mode, the length of a helix is about one wave length and the pitch is $\lambda/n$, and the waves are radiated in an axial direction of the helix.

Meanwhile, in 1~2 GHz band for a mobile communication, the helical antenna is operated typically in the normal mode to produce a linear polarization.

SUMMARY OF THE INVENTION

It is, therefore, an object of the present invention to provide a circular polarized helical radiation element and its array antenna operating at TX/RX dual bands which is high frequency such as Ka band by operating the helical antenna in axial mode and implementing dual feeding structure and the antenna with double reflection boards using that array.

Further, it is another object of the present invention to provide a helical radiation element and its array, which can provide the extremely good radiation efficiency by operating a radiation element in dual band, which has the characteristic of wide band circular polarized waves in the communication system requiring the characteristic of circular polarized waves.

Further, it is another object of the present invention to provide a helical radiation element and its array, which operates in circular polarized waves in the both of separated two frequency bands and is implemented in a waveguide by embodying the helices of tapered shape whose radiuses gradually decrease using helical antenna operating in circular polarized waves in the TX/RX dual band.

Further, it is another object of the present invention to provide polarized helical radiation element and its array, by using the diversity implementation methods, such as making the helical in the air space, fixing into the groove of a dielectric substance or carving on the dielectric board.

In accordance with an aspect of the present invention, there is provided an apparatus operable in the both of transmission (TX) band and receiving (RX) band, comprising: at least one helical radiation element for radiating orthogonal circular polarized waves in the TX and RX bands, wherein the helical radiation element includes a helix, and opposite ends of the helix are coupled to the two feed lines, respectively In accordance with another aspect of the present invention, there is provided an array antenna having a number of radiation elements operable in the both of TX band and RX band, wherein the radiation elements are arrayed on predetermined column lines, each radiation element comprising: a helix for radiating orthogonal circular polarized waves in the different frequency bands wherein the helix is fed at its beginning point and its terminating point; and a wave guide for accommodating the helix.

In accordance with another aspect of the present invention, there is provided A circular polarized array antenna, having double reflection boards, of the unit radiation elements operating in circular polarized waves in the TX/RX band, comprising: a reflection means for transmitting and receiving signals after reflecting twice; and a feed array unit having a number of radiation elements which are arrayed in a predetermined interval, wherein the radiation element includes a helix for radiating orthogonal circular polarized waves in the different frequency bands wherein the helix is fed at its beginning point and its terminating point; and a waveguide for accommodating the helix.

In accordance with another aspect of the present invention, there is provided a method for preparing a helical antenna, comprising the steps of: forming a pattern of a plurality of arcs on a dielectric board, wherein the shape of the dielectric board has fan-shaped structure; positioning a number of conductor arcs for making a helix after transforming the fan-shaped dielectric board into a cone structure; electrically coupling joining parts of conductor arcs helical structure to thereby for the helix; and electrically connecting opposite points of the helix to two feeding ports, respectively.

BRIEF DESCRIPTION OF THE DRAWINGS

The above and other objects and features of the present invention will become apparent from the following description of the preferred embodiments given in conjunction with the accompanying drawings, in which:

FIGS. 6A and 6B are graphs showing the simulation results for the receiving gain radiation pattern and receiving axial ratio of the helical radiation element in accordance with an embodiment of the present invention;

DETAILED DESCRIPTION OF THE INVENTION

Hereinafter, the preferred embodiments of the present invention will be explained in detail with reference to the accompanying drawings.

Figure 1:
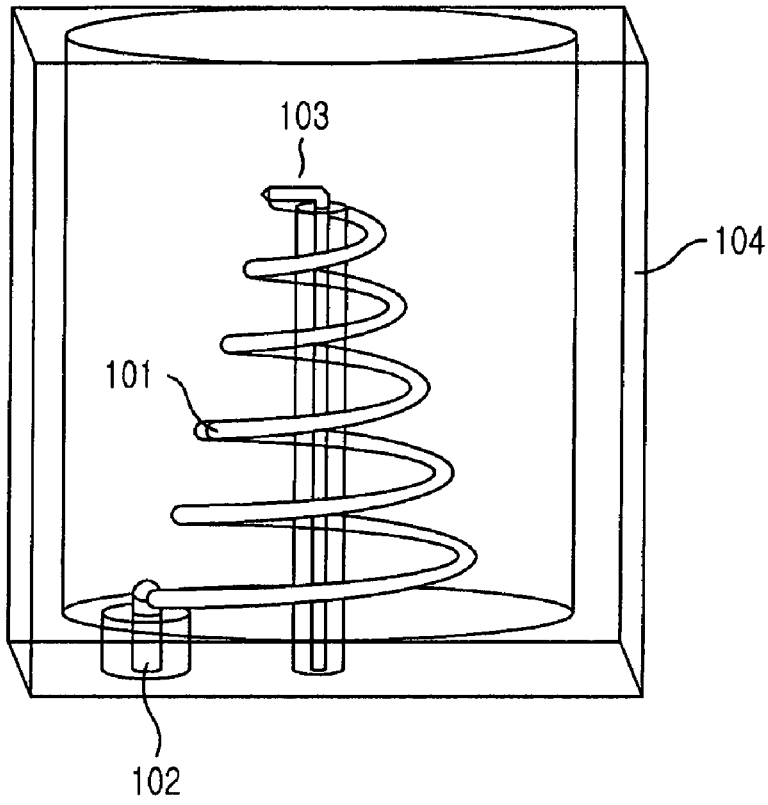
FIG. 1 illustrates a helical radiation element in accordance with an embodiment of the present invention.

FIG. 1 illustrates a helical radiation element in accordance with an embodiment of the present invention.

As shown, the helical radiation element in accordance with the present invention is a unit radiation element which has a helix 101 inserted in a waveguide 104. And the structure of the helical radiation element is prepared by soldering the helix 101 to a receiving feed point 102 connected to a receiving port (not shown) and the transmission feed point 103 connected to a transmission port (not shown).

The operation of the helical radiation element in accordance with the present invention is described as follows.

In the receiving (RX) band, right circular polarized waves are produced since the electromagnetic field is produced in the right-hand direction along with the helix 101 about the receiving feed point 102.

Meanwhile, in the transmission (TX) band, left circular polarized waves are produced since the electromagnetic field is produced in the left-hand direction along with the helix 101 about the transmission feed point 103.

The above two circular polarized waves, a right-hand circular polarized wave and a left-hand circular polarized wave, are orthogonal to each other.

The electromagnetic characteristic of the radiation element in RX band is stable since the propagation wave is radiated in the same direction of the traveling direction of the electromagnetic field. But, the electromagnetic characteristic in TX band, e.g., axial ratio characteristic may be variable according to a space between the helix and the bottom of the waveguide since the electromagnetic field is traveled from up to down and after reflecting on the bottom of the waveguide, is radiated in the front direction.

The electromagnetic characteristic of the helical radiation element mainly depends on helix diameters of the first and second turns, those of turns more than third turn are less influenced on the characteristic of the axial ratio characteristic.

The circular polarization of the axial-mode helical antenna can be improved according to the increased number of the turns. The number of the turns of the present embodiment is e.g., five, considering both of the axial ratio and the convenient for preparation thereof.

The details of the helical radiation element in accordance with the present embodiment are described as follows:

The helix diameter at the first turn from the bottom of the waveguide is e.g., 6.4 mm and as the number of turns is increased the helix diameters decrease gradually, so that the helix diameter at the fifth turn becomes e.g., 2.0 mm, and the height of the helix is e.g., 8.0 mm, and the diameter of the waveguide is e.g., 10.0 mm, and the diameter of the helix conductor is e.g., 0.3 mm.

The helix structure of the present invention producing in an air space can be more efficient than the helix structure using a dielectric but is not stronger than the helix structure employing the dielectric against the external impact.

However, the above weakness problem against the external impact can be solved by performing the heat treatment on the helix structure to thereby increase the ability of the restoration or by securing the helical in the waveguide to protect it from the external impact.

Figure 2A:
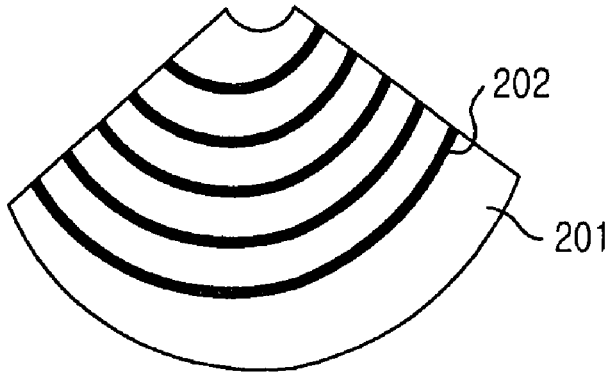
FIGS. 2A, 2B and 2C are exemplary diagrams for explaining the method for preparing the helical radiation element in accordance with the present invention.
Figure 2B:
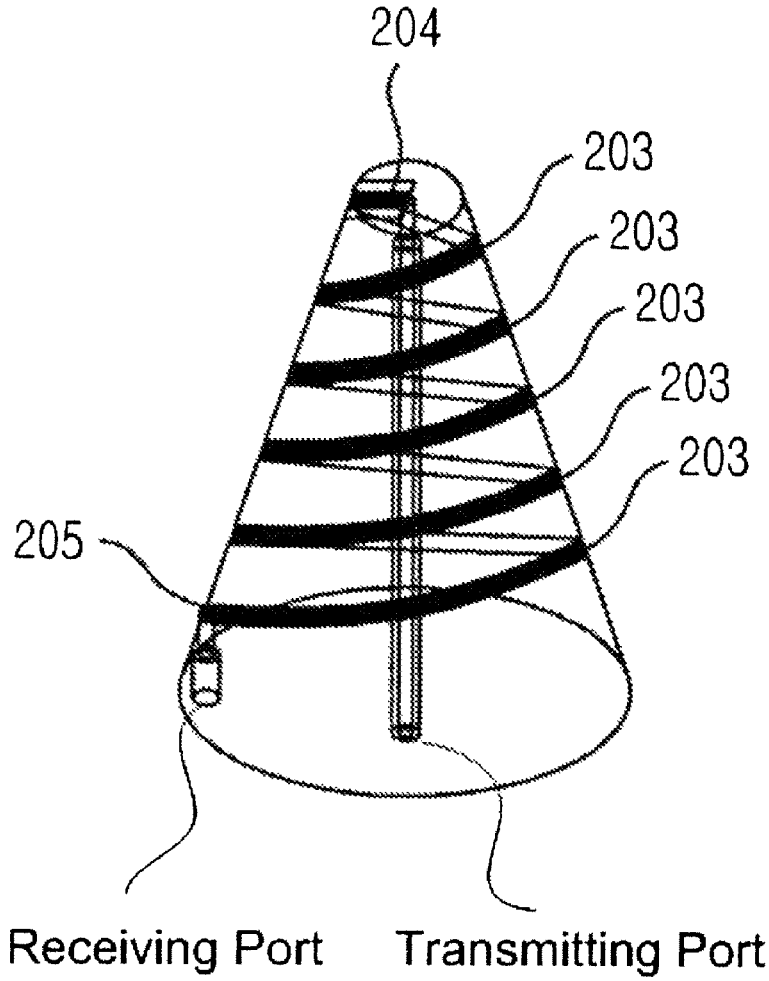
Figure 2C:
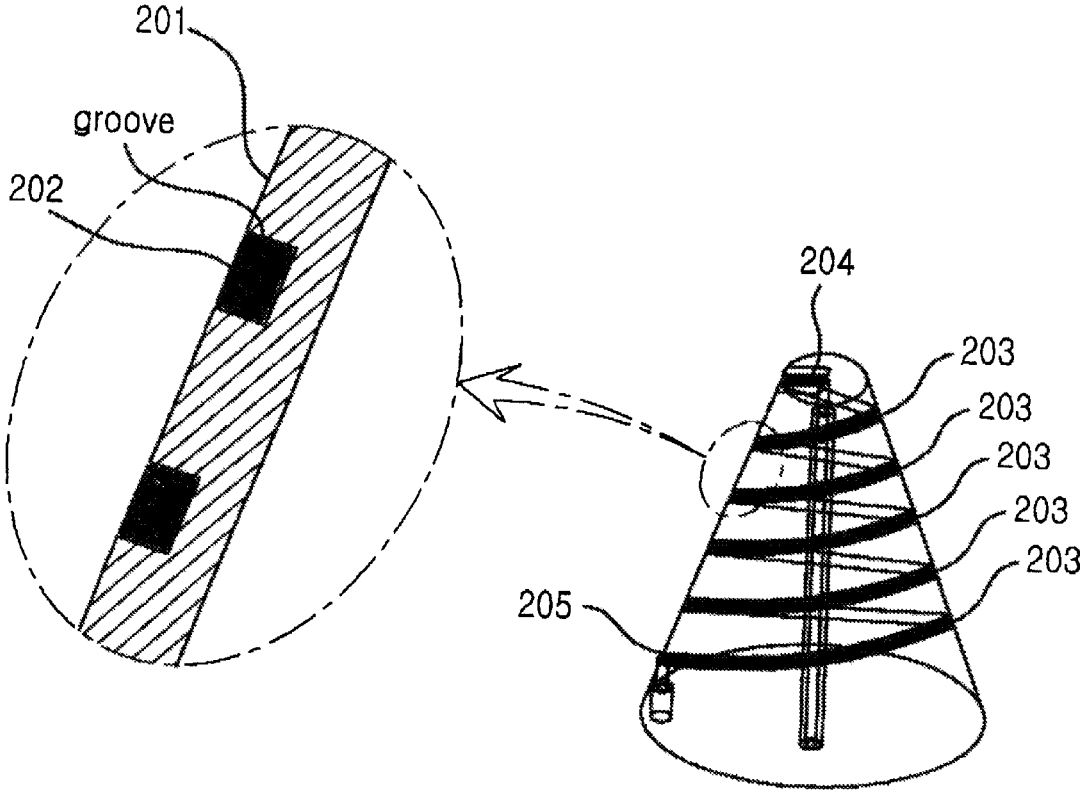

FIGS. 2A, 2B and 2C are exemplary diagrams for explaining the method for preparing the helical radiation element in accordance with one embodiment of the present invention.

First, referring FIG. 2A, a plurality of conductor-strip arcs having the constant interval there between are formed as a pattern of the arcs on a, e.g., fan-shaped dielectric board 201 by using, e.g., a photo lithographic process. Herein, the center of the conductor-strip arcs carved 202 is located at a predetermined point that is slightly deviated from the center of the arc circumference for the dielectric board 201. As a result, when the fan-type dielectric board is reformed into a cone structure as shown in FIG. 2B, the conductor-strip arcs are coupled to each other to thereby form a helix or a spiral.

In that case, the joining parts 203 of the conductor arcs on the cone structure are electrically coupled to each other by using a soldering method.

Then, the opposite ends 204 and 205 of the helix are electrically coupled to two feed points respectively by using a soldering method.

Figure 3:
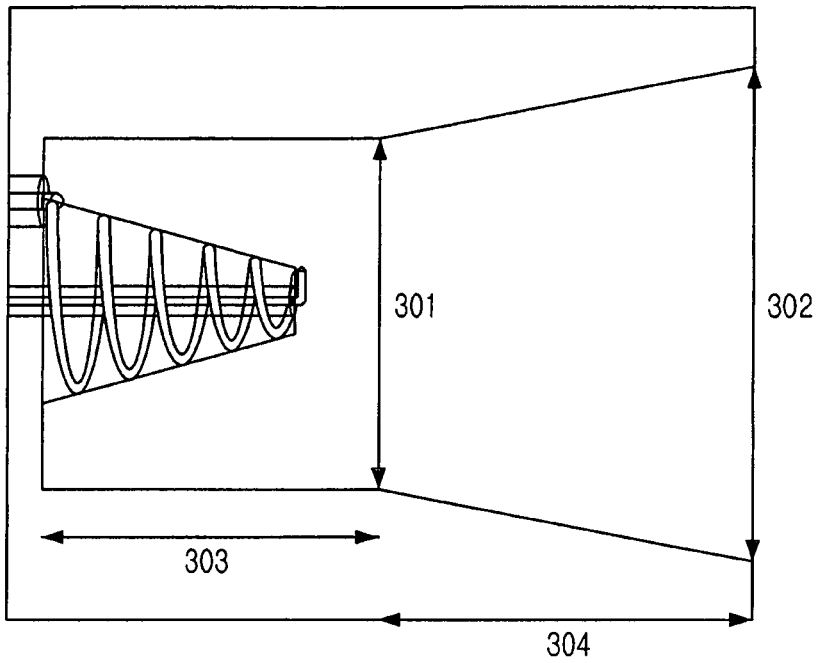
FIG. 3 illustrates a helical radiation element in accordance with another embodiment of the present invention.

FIG. 3 illustrates a helical radiation element in accordance with another embodiment of the present invention.

As shown, the helical radiation element in accordance with another embodiment employs another type of waveguide.

More specifically, a helix structure is identical to that shown in FIG. 1 or 2. But a waveguide is different from that shown in FIG. 1. The waveguide contains two parts 303 and 304. The diameter of the second part of waveguide 304 is gradually increased in order to be capable of controlling the gain of a unit radiation element, because the gain of antenna is determined depending on the diameter of the final aperture 302 of the radiation element.

The diameter of the first part of waveguide 301 is determined in order to obtain a desired performance in the both of RX 20 GHz and TX 30 GHz bands.

The diameter 301 of the first part of the waveguide is preferably, e.g., 10.0 mm and the final diameter 302 of end portion of the second part is preferably, e.g., 14.0 mm. And this circular waveguide is applied to the array explained later on.

If the diameter 301 of the first part is too small, the electromagnetic wave may not be propagated due to the increased cutoff frequency.

And, if the diameter 301 is too great, although the cutoff frequency is decreased, the high order mode as well as the basic mode may be passed through the operation frequency band. Consequently, a distortion in beam pattern or a decrease in radiated efficiency may be caused.

Figure 4A:
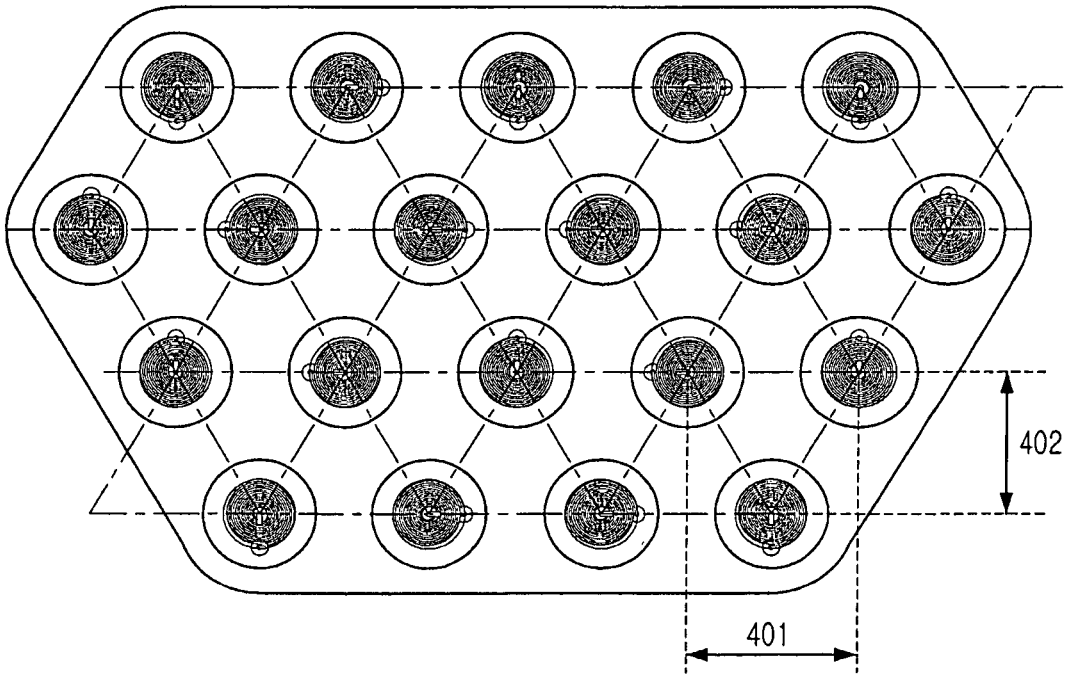
FIG. 4A is an exemplary diagram for showing an array of helical radiation elements in accordance with an embodiment of the present invention.

FIG. 4A is an exemplary diagram for showing an array of helical radiation elements in accordance with an embodiment of the present invention As shown, the array includes a number of unit radiation elements arrayed in a predetermined interval, wherein the unit radiation element is preferably the helical radiation element.

According to the embodiment of the present invention, the interval of the unit radiation elements is e.g., 15.0 mm, in order to operate the radiation elements arrayed in a left and right direction 401, an up and down direction 402 in both TX and RX bands and the number of radiation elements arrayed is e.g., 20. It can be clearly appreciated that the interval and the number of radiation elements can be selected according to the requirement of the system.

The number of the radiation elements arranged in neighboring lines is different from each other and each radiation element on an array is located on a position on the array column corresponding to the middle portion between two neighboring radiation elements on the upper or lower array column to reduce the level of side lobe so that the characteristic of a beam pattern can be improved.

Figure 4B:
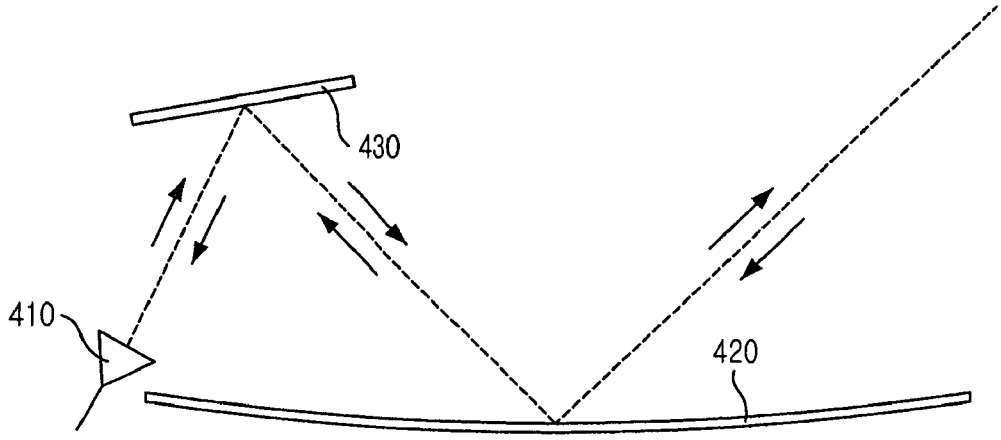
FIGS. 4B and 4C respectively illustrates a side view and a front view of an antenna employing a double reflection board using the array of helical radiation elements in accordance with an embodiment of the present invention.
Figure 4C:
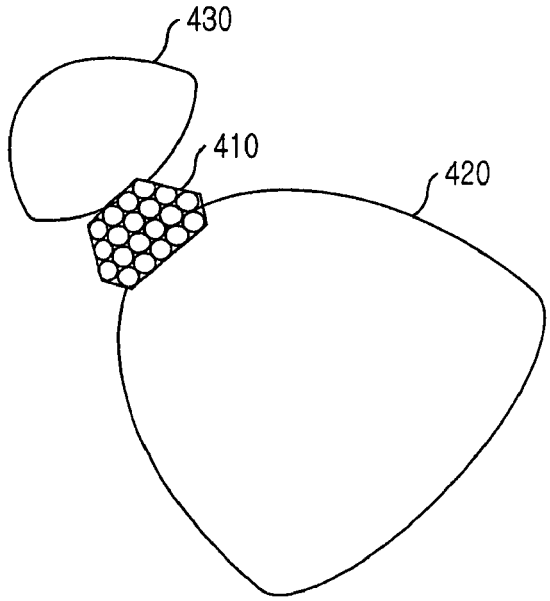

FIGS. 4B and 4C respectively illustrates a side view and a front view of an array antenna with a double reflection board using the array of helical radiation elements in accordance with an embodiment of the present invention.

Referring to FIG. 4B, the array antenna with the double reflection board using the array of helical radiation elements in accordance with an embodiment of the present invention includes the helical feed array 410, a main reflection board 420 and a side reflection board 430.

The helical feed array 410 is a power feed array including the above explained array of the helical radiation elements.

In an antenna system such as the satellite communication system, the array of the helical radiation elements included in the helical feed array 410 of the present embodiment can be combined with the side reflection board 430 and the main reflection board 420. As a result, the characteristic of the antenna gain and beam scanning can be improved and the level of the side lobe also can be decreased in a controlled triangle structure.

In the present embodiment, the helical feed array 410 consist of e.g., 20, radiation elements which are arrayed 4, 5, 6 and 5 on the lines, respectively, so that the space efficiency of main reflection board 420 and side reflection board 430 can be greatly improved.

Figure 5:
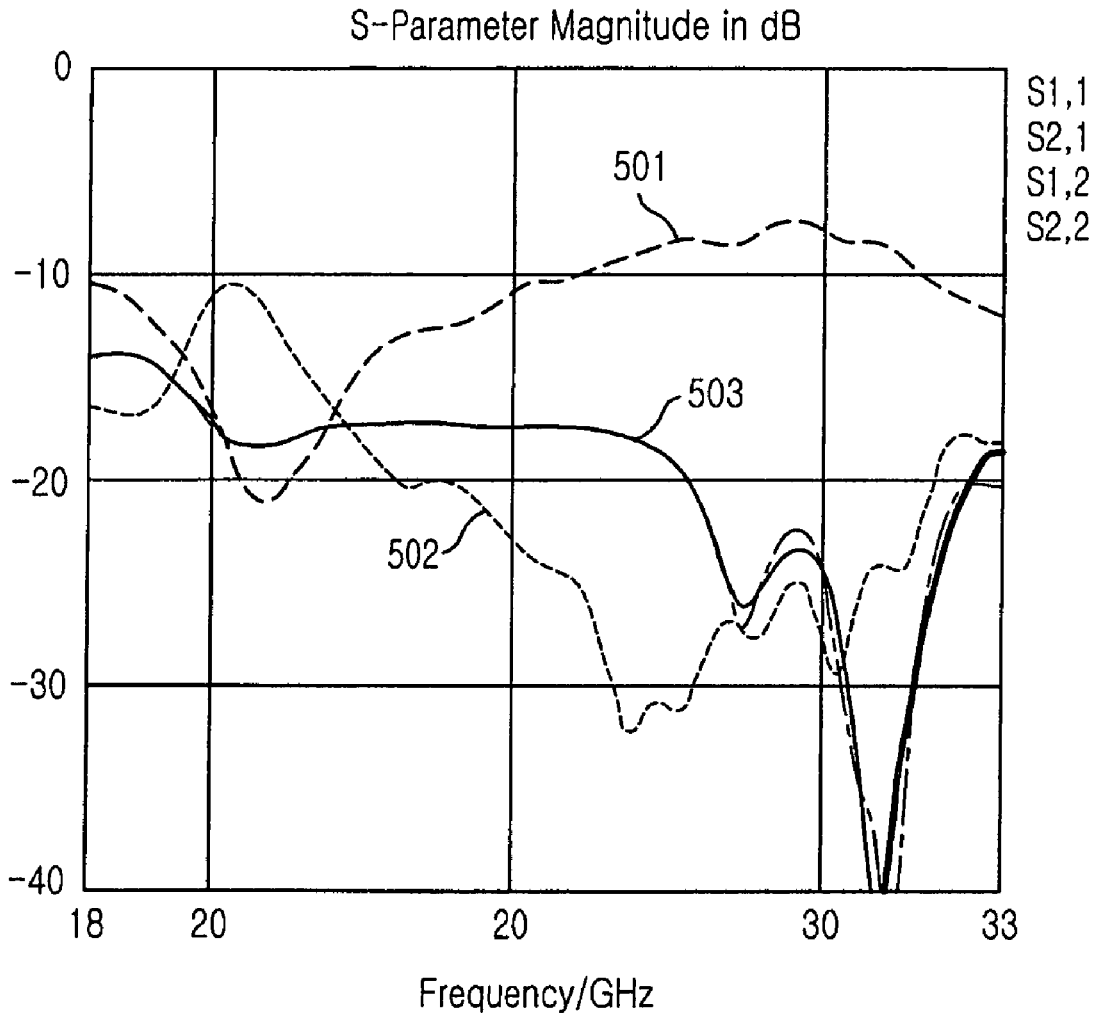
FIG. 5 is a graph of a simulation result for demonstrating mutual isolation and reflection coefficient of the helical radiation element in accordance with an embodiment of the present invention.

FIG. 5 is a graph showing a simulation result for mutual isolation and reflection coefficient of helical radiation element produced in accordance with an embodiment of the present invention.

The helical radiation element prepared by using a method described in FIG. 2 is employed in order to obtain a following simulation result.

That is, the embodiment of FIG. 2 using a dielectric board is selected as a simulation model among embodiments of FIGS. 1, 2 and 3 because the characteristic of the embodiment of FIG. 2 is less stable than the embodiments of FIGS. 1 and 3 depending on a dielectric characteristic. The other embodiments have almost the same characteristic.

As shown, a receiving reflection coefficient 501 of the helical radiation element in accordance with the present invention is under −15 dB in the RX band, and a transmission reflection coefficient 503 is under −20 dB in the TX band. The characteristic of isolation 502 is under −15 dB in the both of the TX and RX bands and, particularly, the characteristic of isolation 502 is under −25 dB in the TX band.

As can be seen from the above result, the helical radiation element in accordance with the present invention has a good reflection coefficient and a good characteristic of isolation.

Figure 6B:
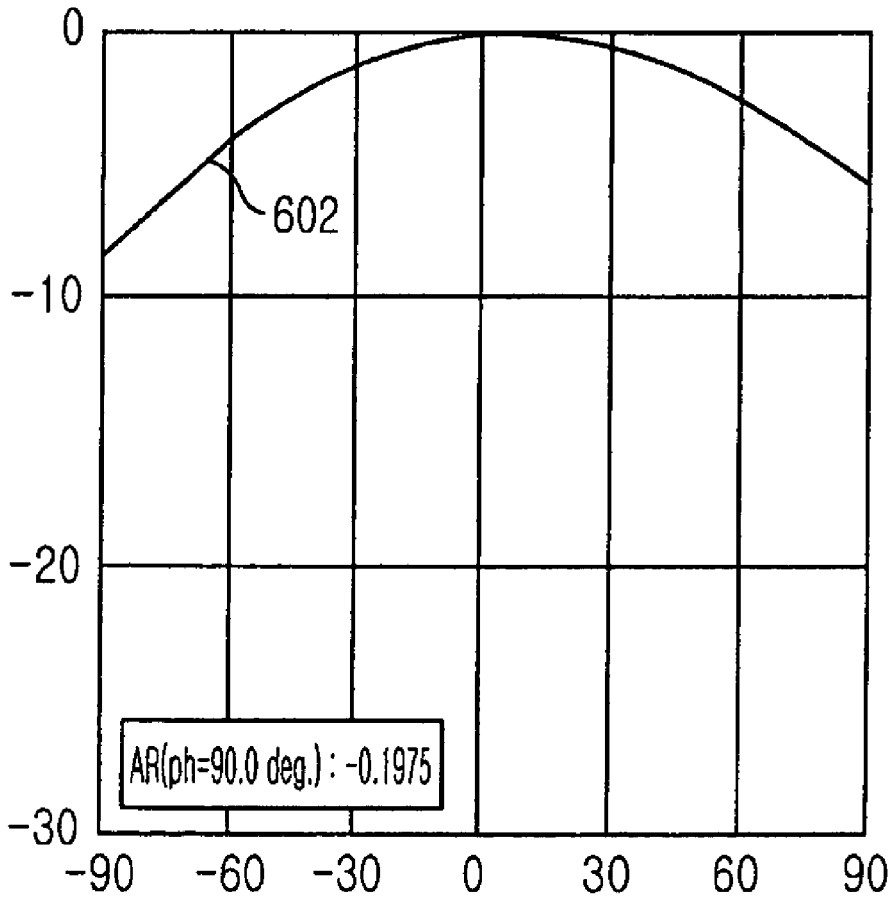

FIGS. 6A and 6B are graphs showing the simulation results for a receiving gain radiation pattern and receiving axial ratio of the helical radiation element in accordance with an embodiment of the present invention.

Referring to FIG. 6A, the helical radiation element in accordance with the present invention has the receiving gain radiation pattern 601 of about 9.8 dBi in the propagation direction at the 20.755 GHz of the receiving center frequency.

Referring to FIG. 6B, the characteristic of receiving axial ratio 602 is 0.2 dB in the propagation direction which represents a good characteristic of receiving axial ratio. The same results are obtained in all over the receiving frequency band because the structure of the helical is a broad band structure.

Figure 7A:
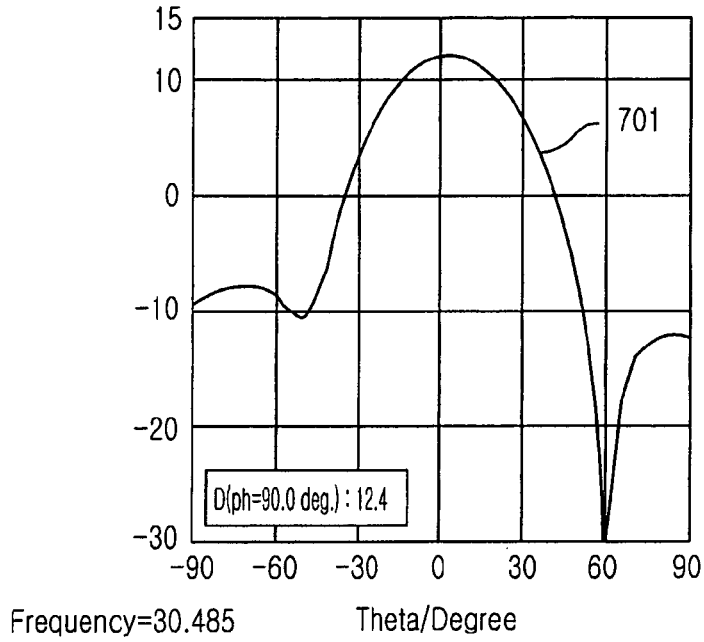
FIGS. 7A and 7B are graphs showing simulation results for the transmission gain radiation pattern and transmission axial ratio of the helical radiating produced in accordance with an embodiment of the present invention.
Figure 7B:
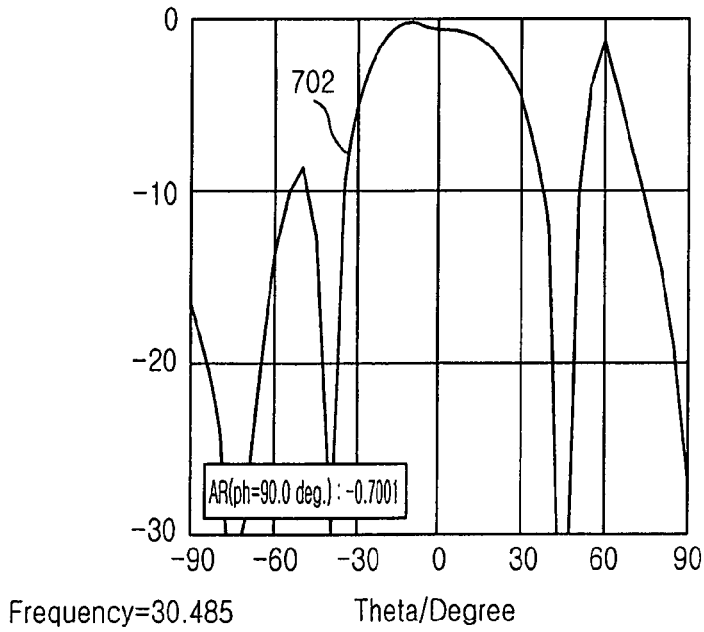

FIGS. 7A and 7B are graphs showing simulation results for a transmission gain radiation pattern and a transmission axial ratio of a helical radiation element in accordance with an embodiment of the present invention.

Referring to FIG. 7A, the helical radiation element in accordance with the present invention has the transmission gain radiation pattern 701 of about 12.4 dBi in the propagation direction at the 30.485 GHz of the transmission center frequency.

Referring to FIG. 7B, the characteristic of transmission axial ratio 702 is 0.7 dB in the propagation direction which represents a good result of transmission axial ratio. The same results are obtained all over the transmission frequency band because of the same reason above mentioned.

Although the transmission axial ratio characteristics slightly change according to the directional angle compared with the receiving axial ration characteristics, the stable and desired transmission axial ratio characteristic is obtained by using the array having a directional angle under ten degree.

While the present invention has been described with respect to certain preferred embodiments, it will be apparent to those skilled in the art that various changes and modifications may be made without departing from the scope of the invention as defined in the following claims.

The present invention provides a circular polarized helical radiation element and its array antenna. The array antenna contains a double reflection board and the array antenna can operate at TX/RX dual high frequency band, such as Ka band, by employing helical radiation elements operated in axial mode and implemented in a dual feeding structure.

Also, the present invention provides a helical radiation element and its array, which can provide the extremely good radiation efficiency by operating a radiation element in a dual band, which is capable of radiating desired broad band circular polarized waves in the communication system.

Also, the present invention can provide a polarized helical radiation element and its array, by using a diversity implementation methods, such as forming a helix in an air space; fixing a helix into a groove (see FIG. 2C) of a dielectric substance; forming a helix on the dielectric board by using a photo lithographical technique.

Also, the present invention provides a circular polarized helical radiation element operable in the both of TX/RX high frequency bands, which can be applied to the satellite communication system, such as Ka band and can effectively provide a compact system having improved system characteristics.

Also, the present invention provides a method for preparing a helical antenna capable of protecting its structure from the external impact by fixing its helix at the groove in the dielectric or performing a heat treatment on its helix and reducing the inconveniences or complexity in a mass production by using a photo lithographic process.

What is claimed is:

1. An apparatus operable in each of a transmission (TX) band and a receiving (RX) band, comprising:

at least one helical radiation element for radiating orthogonal circular polarized waves in the TX and RX bands, wherein the helical radiation element includes a helix;

a two-part circular wave guide including a first part surrounding the helix and a second part having a diameter that is increased in a predetermined ratio, the first part surrounding the helix having a constant diameter;

a first feed line coupled to a first end of the helix; and a second feed line coupled to a second end of the helix, wherein the first feed line is coupled to a receiving feed point coupled to a receiving port for operation in the RX band, and the second feed line is coupled to a transmitting feed point coupled to a transmitting port for operation in the TX band, wherein the receiving port is physically separate from the transmitting port to enable simultaneous operation in both the TX band and the RX band, wherein the helix has a predetermined number of turns and a diameter of the helix is gradually increased or decreased in a predetermined ratio, depending on the number of turns.

2. The apparatus as recited in claim 1, wherein the helical radiation element includes: a transmission feed means for radiating circular polarized waves of a TX band, which is located at an end point of the helix; and a receiving feed means for receiving circular polarized waves of a RX band, which is located at an opposite end point of the helix, wherein the receiving circular polarized waves are orthogonal to the radiating circular polarized waves.

3. The apparatus as recited in claim 1, wherein the helix is supported by employing a dielectric member.

4. The apparatus as recited in claim 3, wherein the dielectric member has a groove accommodating the helix.

5. The apparatus as recited in claim 1, wherein the helix is formed using a photolithographic process for forming a conductor-strip arc pattern on the dielectric member and a soldering process for electrically coupling the arcs on the pattern with each other, wherein a dielectric member is reformed in a cone-shaped structure.

6. The radiation apparatus as recited in claim 2, wherein the transmission feed means is coupled to the end point of the helix .

7. An array antenna having a number of radiation elements operable in each of a TX band and an RX band, wherein the radiation elements are arrayed on predetermined column lines, each radiation element comprising:

a helix for radiating orthogonal circular polarized waves in the different frequency bands wherein the helix is fed at a first feed line at a beginning point and a second feed line at a terminating point; and a two-part circular wave guide including a first part surrounding the helix and a second part having a diameter that is increased in a predetermined ratio, the first part surrounding the helix having a constant diameter;

wherein the first feed line is coupled to a receiving feed point coupled to a receiving port for operation in the RX band, and the second feed line is coupled to a transmitting feed point coupled to a transmitting port for operation in the TX band, to enable simultaneous operation in both the TX band and the RX band, and wherein the helix has a predetermined number of turns and a diameter of the helix is gradually increased or decreased in a predetermined ratio, depending on the number of turns.

8. The array antenna as recited in claim 7, further comprising a first reflection board and a second reflection board for radiating and receiving the orthogonal polarized waves by implementing double reflection of the orthogonal polarized waves.

9. A circular polarized array antenna, having double reflection boards and unit radiation elements capable of operating with circular polarization waves in each of a TX band and an RX band, comprising:

a reflection means for transmitting and receiving signals after reflecting twice; and a feed array unit having a number of radiation elements which are arrayed in a predetermined interval, wherein the radiation element includes a helix for radiating orthogonal circular polarized waves in the different frequency bands wherein the helix has a first feed line at a beginning point and a second feed line at a terminating point; and a two-part circular wave guide including a first part surrounding the helix and a second part having a diameter that is increased in a predetermined ratio, the first part surrounding the helix having a constant diameter;

wherein the first feed line is coupled to a receiving feed point coupled to a receiving port for operation in the RX band, and the second feed line is coupled to a transmitting feed point coupled to a transmitting port for operation in the TX band, to enable simultaneous operation in both the TX band and the RX band, and wherein the helix has a predetermined number of turns and a diameter of the helix is gradually increased or decreased in a predetermined ratio, depending on the number of turns.

10. A method for preparing a helical antenna, comprising the steps of:

forming a pattern of a plurality of arcs on a dielectric board, wherein the shape of the dielectric board has a fan-shaped structure;

positioning a number of conductor arcs for making a helix after transforming the fan-shaped dielectric board into a cone structure;

electrically coupling joining parts of said conductor arcs to form the helix; and electrically connecting opposite points of the helix to two feeding ports, respectively, the two feeding ports including a first feed line at a beginning point and a second feed line at a terminating point, wherein the first feed line is coupled to a receiving feed point coupled to a receiving port for operation in the RX band, and the second feed line is coupled to a transmitting feed point coupled to a transmitting port for operation in the TX band, to enable simultaneous operation in both the TX and the RX bands.

11. The method as recited in claim 10, wherein a center of the conductor arcs is located at a point that is deviated from a center of an arc circumference of the fan shaped dielectric board to form the helix when the dielectric board is transformed into the cone structure.

* * * * *